US009676577B2

(12) United States Patent
Schoenmakers et al.

(10) Patent No.: US 9,676,577 B2
(45) Date of Patent: Jun. 13, 2017

(54) SHEET HANDLING APPARATUS

(71) Applicant: CANON KABUSHIKI KAISHA, Tokyo (JP)

(72) Inventors: Erik Jozef Wilhelmus Schoenmakers, Venlo (NL); Rob Josephus Elisabeth Looijmans, Someren (NL)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/868,199

(22) Filed: Sep. 28, 2015

(65) Prior Publication Data

US 2016/0096698 A1 Apr. 7, 2016

(30) Foreign Application Priority Data

Oct. 2, 2014 (EP) ..... 14003407

(51) Int. Cl.

| | |
|---|---|
| ***B65H 9/00*** | (2006.01) |
| ***B65H 7/10*** | (2006.01) |
| ***B65H 9/16*** | (2006.01) |
| ***B65H 5/06*** | (2006.01) |
| ***B65H 7/20*** | (2006.01) |
| ***B65H 37/00*** | (2006.01) |

(52) U.S. Cl.

CPC ..... *B65H 9/002* (2013.01); *B65H 5/062* (2013.01); *B65H 5/068* (2013.01); *B65H 7/10* (2013.01); *B65H 7/20* (2013.01); *B65H 9/166* (2013.01); *B65H 37/00* (2013.01); *B65H 2404/144* (2013.01); *B65H 2511/11* (2013.01); *B65H 2511/224* (2013.01); *B65H 2511/414* (2013.01); *B65H 2601/25* (2013.01)

(58) Field of Classification Search

CPC ..... B65H 5/062; B65H 9/002; B65H 9/166; B65H 7/08; B65H 7/10; B65H 9/20

USPC ..... 271/227, 228, 236, 251

See application file for complete search history.

(56) References Cited

U.S. PATENT DOCUMENTS

| | | | | |
|---|---|---|---|---|
| 5,162,857 A * | 11/1992 | Higeta | G03G 15/234 | 271/251 |
| 5,253,862 A * | 10/1993 | Acquaviva | B65H 9/166 | 271/227 |
| 5,697,609 A * | 12/1997 | Williams | B65H 9/002 | 271/228 |
| 6,817,609 B2 | 11/2004 | Halvonik | | |

(Continued)

FOREIGN PATENT DOCUMENTS

| | | |
|---|---|---|
| JP | H09-301577 A | 11/1997 |
| JP | 2003-118882 A | 4/2003 |

*Primary Examiner* — David H Bollinger

(74) *Attorney, Agent, or Firm* — Canon U.S.A. Inc., IP Division

(57) ABSTRACT

A sheet handling apparatus includes a sheet transport path, a pinch and drive mechanism disposed at an entry side of the transport path for conveying the sheets in a transport direction X along the transport path, at least one liftable pinch and drive mechanism disposed at the transport path downstream of said entry side pinch and drive mechanism, a sheet alignment mechanism disposed further downstream at the transport path and arranged to impart a movement in a direction Z normal to the transport direction X to at least a part of a sheet that passes through, and a controller arranged to receive a sheet length signal and to control said at least one liftable pinch and drive mechanism in accordance with the sheet length.

10 Claims, 4 Drawing Sheets

(56) References Cited

U.S. PATENT DOCUMENTS

| | | | | |
|---|---|---|---|---|
| 7,686,299 | B2 * | 3/2010 | Herrmann | B65H 9/12<br>271/228 |
| 7,686,300 | B2 * | 3/2010 | Watanabe | B65H 9/16<br>271/228 |
| 7,722,039 | B2 * | 5/2010 | Shoji | B65H 7/02<br>271/228 |
| 8,328,188 | B2 * | 12/2012 | Mandel | B65H 9/002<br>271/228 |
| 2009/0096155 | A1 * | 4/2009 | Deckard | B65H 9/002<br>271/228 |
| 2013/0174703 | A1 * | 7/2013 | Maenishi | B26D 7/015<br>83/72 |
| 2013/0277909 | A1 * | 10/2013 | Ino | B65H 7/10<br>271/228 |

* cited by examiner

SHEET HANDLING APPARATUS

BACKGROUND OF THE INVENTION

Field of the Invention

The present invention relates to a sheet handling apparatus.

Description of the Related Art

Examples of sheet handling apparatus include stackers, sorters, staplers, binders, folders and the like, that are typically arranged in a print production line so as to receive a sequence of media sheets that have been printed in a printer or copier. Frequently it is desired that the sheets, before they are processed further, are aligned correctly in the direction Z in the plane of the transport path and normal to the transport direction X. For example, a lateral edge of the sheets should be oriented in parallel with the transport direction X, and preferably the position of this edge in the direction Z should be identical for all sheets. In a practical reproduction line, however, this requirement is not always fulfilled when the sheets arrive at the handling apparatus. The sheets may be offset relative to one another in the direction Z and/or may be skewed, i.e. rotated in the X-Z plane.

The sheet alignment mechanism is provided for correcting at least one of these alignment errors or preferably both of them (a so-called SZ-correction).

When the sheets to be handled have all the same length, the distance between the last pinch and drive mechanism and the sheet alignment mechanism may be selected such that the pinch and drive mechanism releases the trailing edge of the sheet when a leading part of the sheet is gripped by the alignment mechanism and the sheet starts to be rotated or moved in the lateral direction Z.

However, when sheets of varying length are to be processed, a situation may occur that a relatively long sheet is supplied and the trailing part of the sheet is still pinched by the last pinch and drive mechanism while the alignment mechanism already attempts to shift or rotate the sheet. In such a case, in order to avoid that the alignment process is compromised or the sheet is damaged, the pinch and drive mechanism is lifted in order to release the sheet under the control of the controller.

U.S. Pat. No. 6,817,609 B2 discloses the sheet handling apparatus of the type indicated above, which has a plurality of liftable pinch and drive mechanisms and is capable of handling a relatively broad bandwidth of sheets with varying lengths and also sheets with varying widths. As is pointed out in this document, when even longer sheets are to be processed, it is necessary to add further liftable pinch and drive mechanisms (and to increase the length of the transport path accordingly), which means that a relatively costly modification of the apparatus is required.

SUMMARY OF THE INVENTION

According to an aspect of the present invention, there is provided a sheet handling apparatus that may be utilized, without modifications in the construction, for handling sheets with extraordinarily long formats. The sheet handling apparatus includes a sheet transport path, a pinch and drive mechanism disposed at an entry side of the transport path for conveying the sheets in a transport direction X along the transport path, at least one liftable pinch and drive mechanism disposed at the transport path downstream of said entry side pinch and drive mechanism, a sheet alignment mechanism disposed further downstream at the transport path and arranged to impart a movement in a direction Z normal to the transport direction X to at least a part of a sheet that passes through, and a controller arranged to receive a sheet length signal and to control said at least one liftable pinch and drive mechanism in accordance with the sheet length, characterized in that the controller is arranged to disable the sheet alignment mechanism when the sheet length is larger than a predetermined threshold.

The controller is arranged to disable the sheet alignment mechanism when the sheet length is larger than a predetermined threshold.

Thus, when the length of a sheet is so large that it cannot be aligned, the sheet alignment mechanism is automatically switched off, so that the sheet can be passed-on, unaligned, but without any risk of the sheet being damaged or warped, and the sheet may still be processed as intended (e.g. stacked, folded or the like). Although the alignment function is not available for such extremely long sheet formats, the invention has the advantage that the main functions of the sheet handling apparatus are still available, so that the apparatus may still be used, and there is no need for an expensive reconfiguration or reconstruction of the apparatus.

More specific optional features of the invention are indicated in the dependent claims. The sheet alignment mechanism may have any known design and may be capable of shifting the sheet in the lateral direction Z or of rotating the sheet for the purpose of skew correction or both.

The sheet length signal may be received from a sensor or a set of sensors that are incorporated in the apparatus or may as well be received from another component in the production line, e.g. the printer which has selected the sheet format to be used for printing or has cut the sheet from an endless web, based upon format specifications in the print job.

Further features of the present invention will become apparent from the following description of exemplary embodiments with reference to the attached drawings.

DESCRIPTION OF THE EMBODIMENTS

Figure 1:
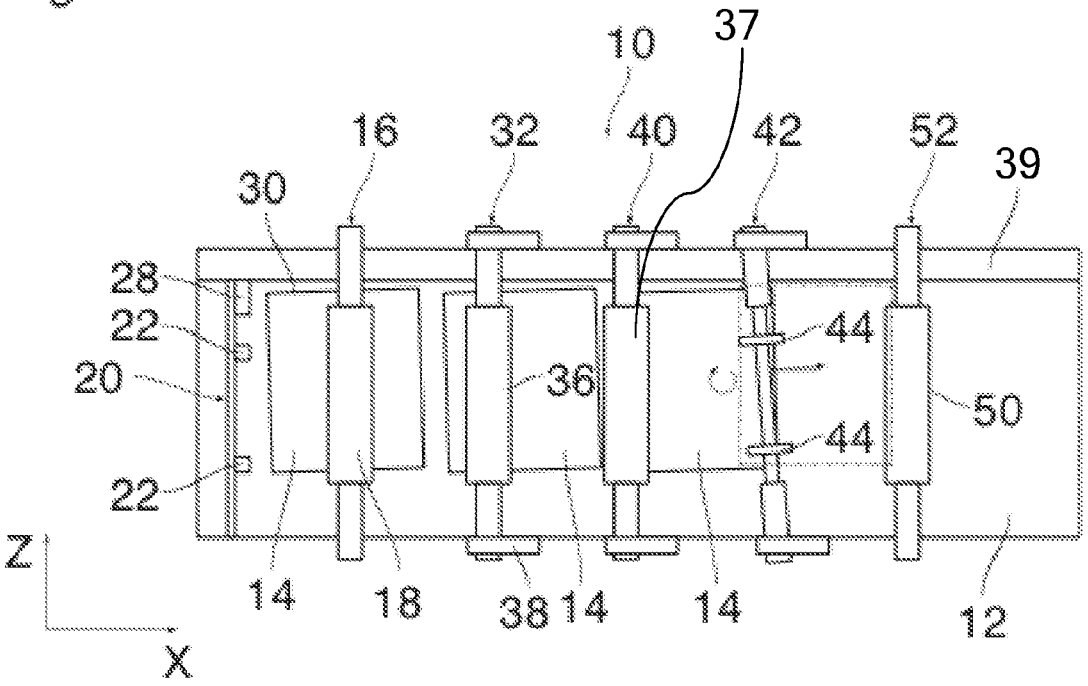
FIG. 1 is a schematic top plan view of a sheet alignment section of a sheet handling apparatus according to the invention.

As is shown in FIG. 1, a sheet alignment section 10 of a sheet handling apparatus comprises a transport path 12 for conveying cut media sheets 14 one after the other in a transport direction X. For example, the sheets 14 may be supplied from a printer where an image has been printed on at least one side of each sheet.

Figure 2:
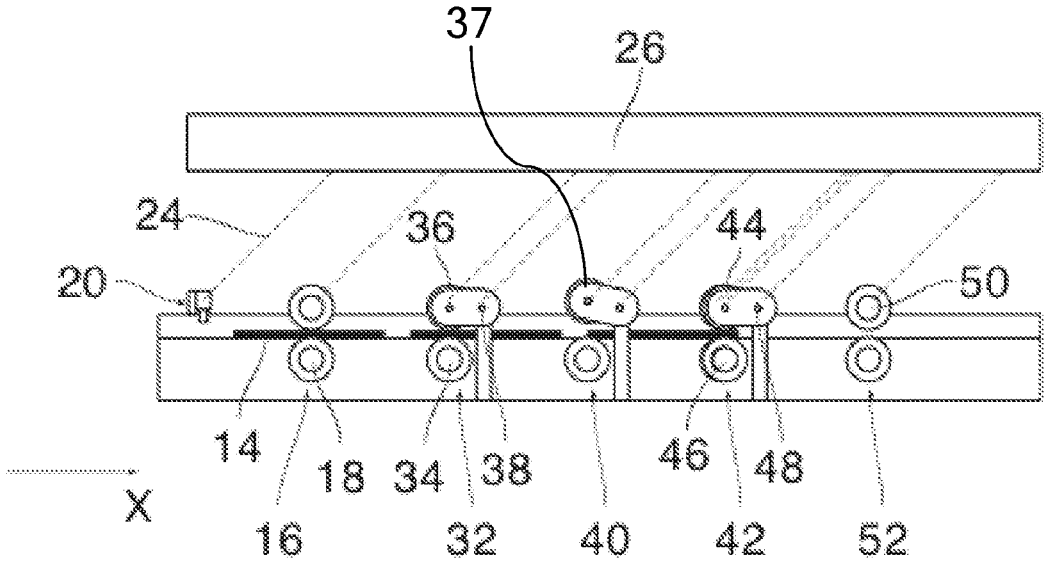
FIG. 2 is a schematic side elevation of the alignment section shown in FIG. 1.

A first pinch and drive mechanism 16 is constituted by a pair of rollers at least one of which is driven for rotation and which form a nip for gripping the sheet 14 and feeding it in the transport direction X (see also FIG. 2).

Further upstream, a sensor array 20 is disposed above the transport path 12. The sensor array comprises two sensors 22 for detecting the leading and trailing edges of the sheets 14 when they pass through. The signals of these sensors permit to derive a skew angle of the sheet as well as a sheet length signal 24 to be transmitted to a controller 26, as has been shown in FIG. 2. Another sensor 28 (FIG. 1) is provided for detecting a lateral edge 30 of the sheets 14 on one side of the transport path 12 (the top side in FIG. 1) which is bounded by a registration wall 32. More precisely, the sensor 28 detects the position of the edge 30 in a direction Z in the plane of the transport path 12 and normal to the transport direction X. These data permit the controller 26 to determine a lateral offset of the sheets 14 in the direction Z, so that an SZ-correction, i.e. a correction of both the skew angle and the Z-position may be performed.

When the trailing edge of the sheet 14 leaves the nip between the rollers 18, the leading edge is pinched in a nip of a second pinch and drive mechanism that is constituted by a lower roller 34 and an upper roller 36 that is liftable by means of a lift mechanism 38. The pinch and drive mechanism 32 is therefore termed a "liftable pinch and drive mechanism".

The sheet 14 is then passed-on to a third pinch and drive mechanism 40 which is also a liftable pinch and drive mechanism. The third pinch and drive mechanism 40 is including a pair of rollers 37.

Subsequently, the sheet is passed-on to a sheet alignment mechanism 42. This sheet alignment mechanism has two pairs of upper and lower rollers 44, 46 which form respective nips for gripping the sheet in the vicinity of its opposite lateral edges. The lower rollers 46 have axes of rotation that are coaxial with one another, but the rollers are adapted to be driven independently from one another by means of respective drive mechanisms which have not been shown here. The upper rollers 44 are liftable by means of another lift mechanism 48 and are also aligned on a common axis of rotation but rotatable independently from one another. The axes of the upper and lower rollers 44, 46 are parallel to one another but slightly inclined relative to the Z-direction. Consequently, when a sheet is gripped between the rollers 44 and 46 of the sheet alignment mechanism, it is fed not exactly in the transport direction X but slants gradually towards the registration wall 32, as has been shown in dot-dashed lines in FIG. 1.

Moreover, based on the skew angle measured by the sensors 22, the controller 26 calculates a skew correction and drives the two pairs of rollers 44, 46 with different speeds so that the sheet 14 is caused to rotate as has been indicated by an arrow in FIG. 1. In this way, the skew error is corrected and the lateral edge 30 is oriented in parallel with the transport direction X even before this lateral edge 30 abuts the registration wall 32. When the sheet engages the registration wall 32 with its lateral edge, the rollers 44, 46 still tend to shift the sheet further in the direction Z. However, the force with which the sheet is pinched between the rollers 44 and 46 is so small, that the sheet is allowed to slip and to rest in engagement with the registration wall 32 in a flat condition and without forming any bulges. Optionally, the lateral force exerted by the rollers 44, 46 may be reduced further by making these disk-like rollers flexible.

Finally, when the SZ-correction has been completed, the leading edge of the sheet is gripped in a nip between rollers 50 of another pinch and drive mechanism 52 on the exit side of the transport path 12 for discharging the sheets to another section (not shown in FIGS. 1 and 2) of the sheet handling apparatus.

The lift mechanisms 38 and 48 are controlled by the controller 26. As has been shown in FIG. 2, the liftable pinch and drive mechanism 40 has been lifted so as to release the sheet as soon as the leading edge is gripped in the nip of the alignment mechanism 42. This assures that the operations of rotating and shifting the sheet under the action of the alignment mechanism 42 is not compromised and does not lead to warping or damage of the sheet, which would be likely to occur when the trailing edge would still be pinched in the pinch and drive mechanism 40.

Figure 3:
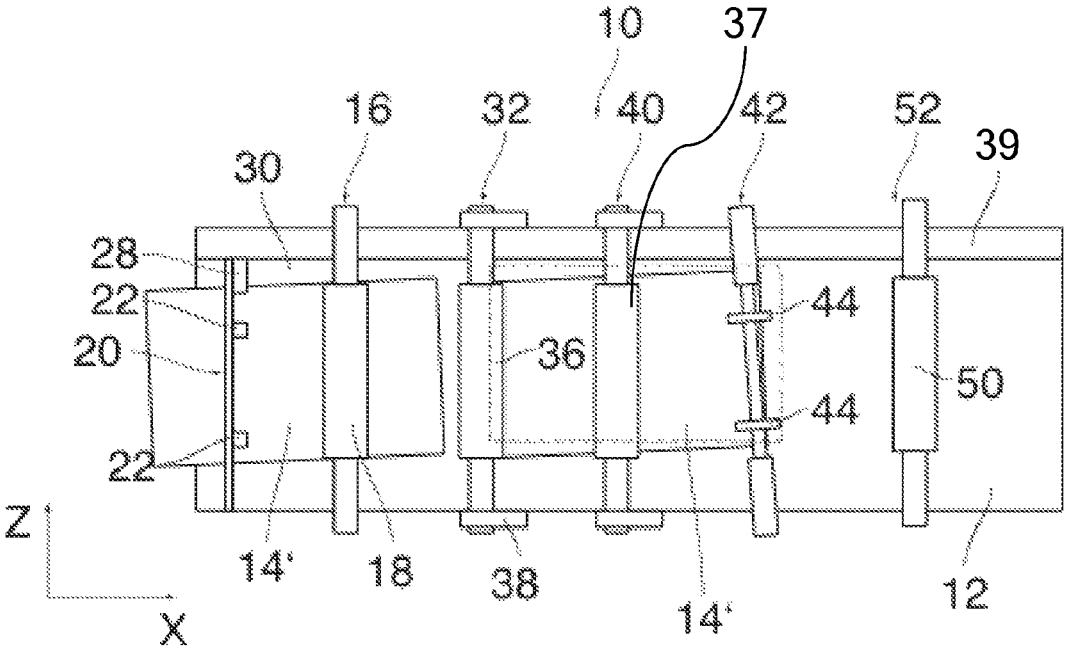
FIGS. 3 to 6 are views corresponding to FIGS. 1 and 2, respectively, illustrating the function of the apparatus with different sheet formats.
Figure 4:
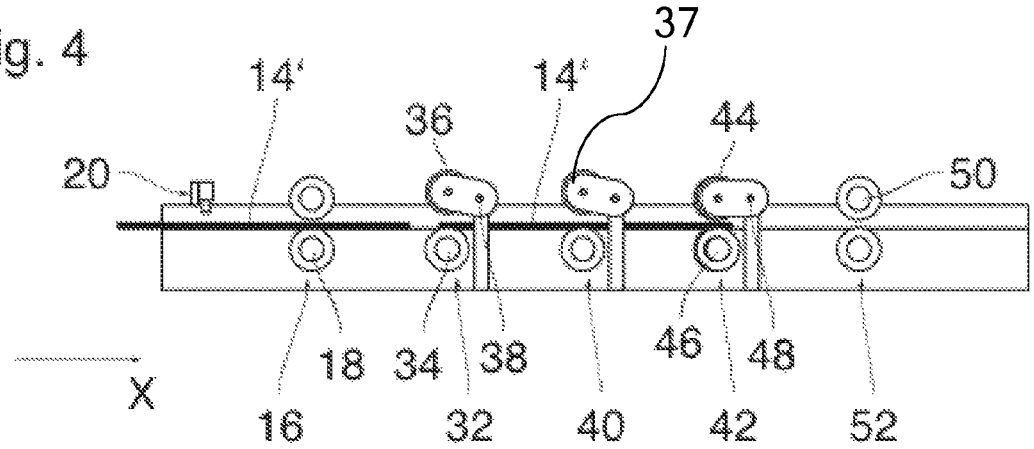

FIGS. 3 and 4 illustrate an example where sheets 14' of a different format are being processed. In particular, the sheets 14' have a greater length. This length can be calculated from the timings at which the sensors 22 detect the leading edge and the trailing edge of each sheet.

The increased length of the sheets 14' has the consequence that, at the instant when the leading edge of the sheet reaches the sheet alignment mechanism 42 and the SZ-correction is to start, the sheet is not only pinched by the third pinch and drive mechanism 40 but also by the second pinch and drive mechanism 32. For this reason, the controller has lifted also the second pinch and drive mechanism 32, so that the trailing edge of the sheet 14' is free to move in Z-direction in the alignment operation.

It will be understood that the movements of the sheets that are necessary for the SZ-correction require a certain time, the so-called correction time. In this example, the rotation of the sheet may only require a relatively short time, but the time needed for the Z-correction is determined by the inclination of the axes of the rollers 44, 46 (which has been exaggerated in the drawing and cannot be made too large in practice) and by the amount of Z-offset of the sheets. This time is however independent from the length of the sheets. Thus, an upper limit for the correction time can be determined by assuming a reasonable upper limit for the Z-offset of the sheets. The position of the exit side pinch and drive mechanism 52 in the transport direction X is selected such that the time which the leading edge of the sheet needs to travel from the alignment mechanism 42 to the pinch and drive mechanism 52 is equal to or larger than the upper limit for the correction time. On the other hand, the distance between the mechanisms 42 and 52 should be small enough to assure that even the sheets 14 with the smallest length can reliably be passed-on from the alignment mechanism 42 to the exit side pinch and drive mechanism 52.

Figure 5:
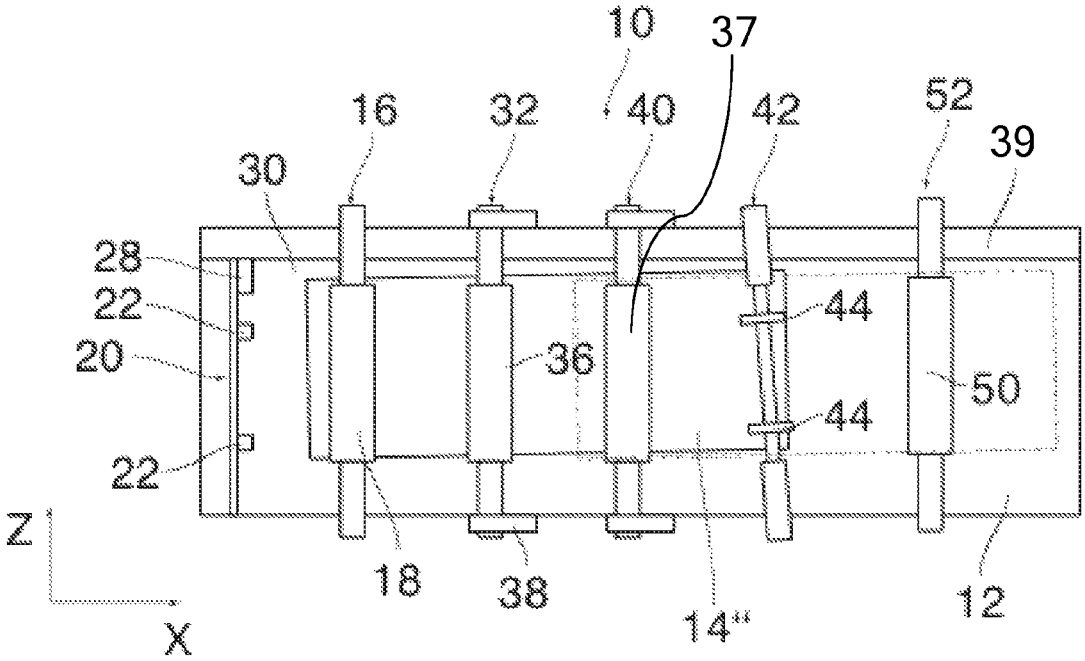
Figure 6:
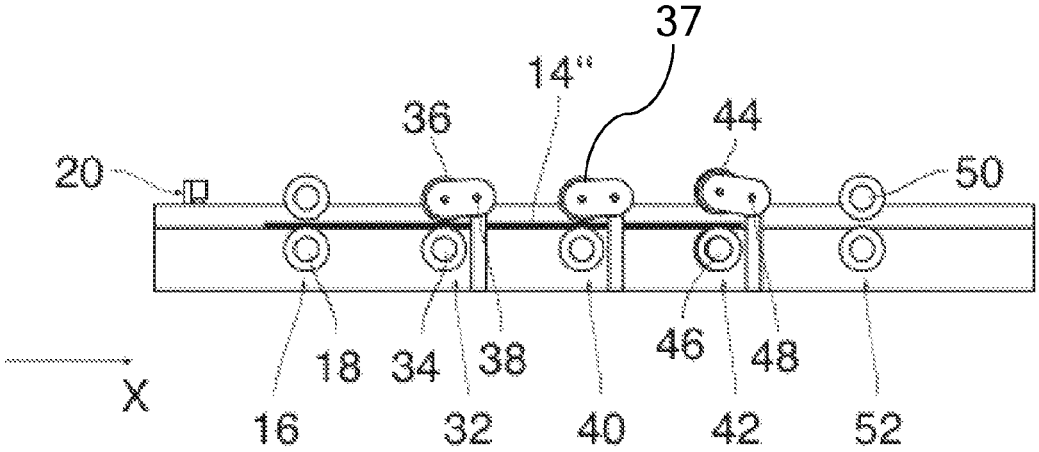

FIGS. 5 and 6 illustrate another example where sheets 14" of yet another format are being processed. In this case, the length of the sheet 14" is extremely large. In particular, it is larger than a threshold that is given by the distance between the first pinch and drive mechanism 16 and the last pinch and drive mechanism 52 minus a distance that the sheet would travel in the maximum correction time. As a consequence, the trailing part of the sheet 14" is still locked in the nip of the first pinch and drive mechanism 16 when the leading edge reaches the alignment mechanism 42. Thus, the sheet 14" cannot be rotated or shifted even when the second and third pinch alignment and mechanisms 32 and 40 are lifted (it would also be difficult to rotate such a long sheet, anyway).

Would the alignment mechanism 42 be operative under these conditions, it would be likely that the sheet 14" is torn and/or warped. For this reason, when the sensors 22 detect a sheet with a length larger than the above threshold, the controller 26 disables the sheet alignment mechanism 42 and, in this example, also activates the lift mechanism 48, so that the alignment mechanism 42 releases the sheet 14" entirely. Consequently, the sheet can be passed-on without jam or damage, although also without SZ-correction as shown in dot-dashed lines in FIG. 5.

The function of the controller 26 controlling the sheet alignment mechanism 42 is based on the sheet length signal 24. It will be understood that, instead of using the sensors 22, this signal can be obtained in any other way, for example, it can be read from a printer from which the sheets are fed, or, if the sheets are supplied with a fixed frequency (a constant number of sheets per minute), the length of the next sheet to be supplied may also be inferred from the length of the preceding inter-sheet interval.

Figure 7:
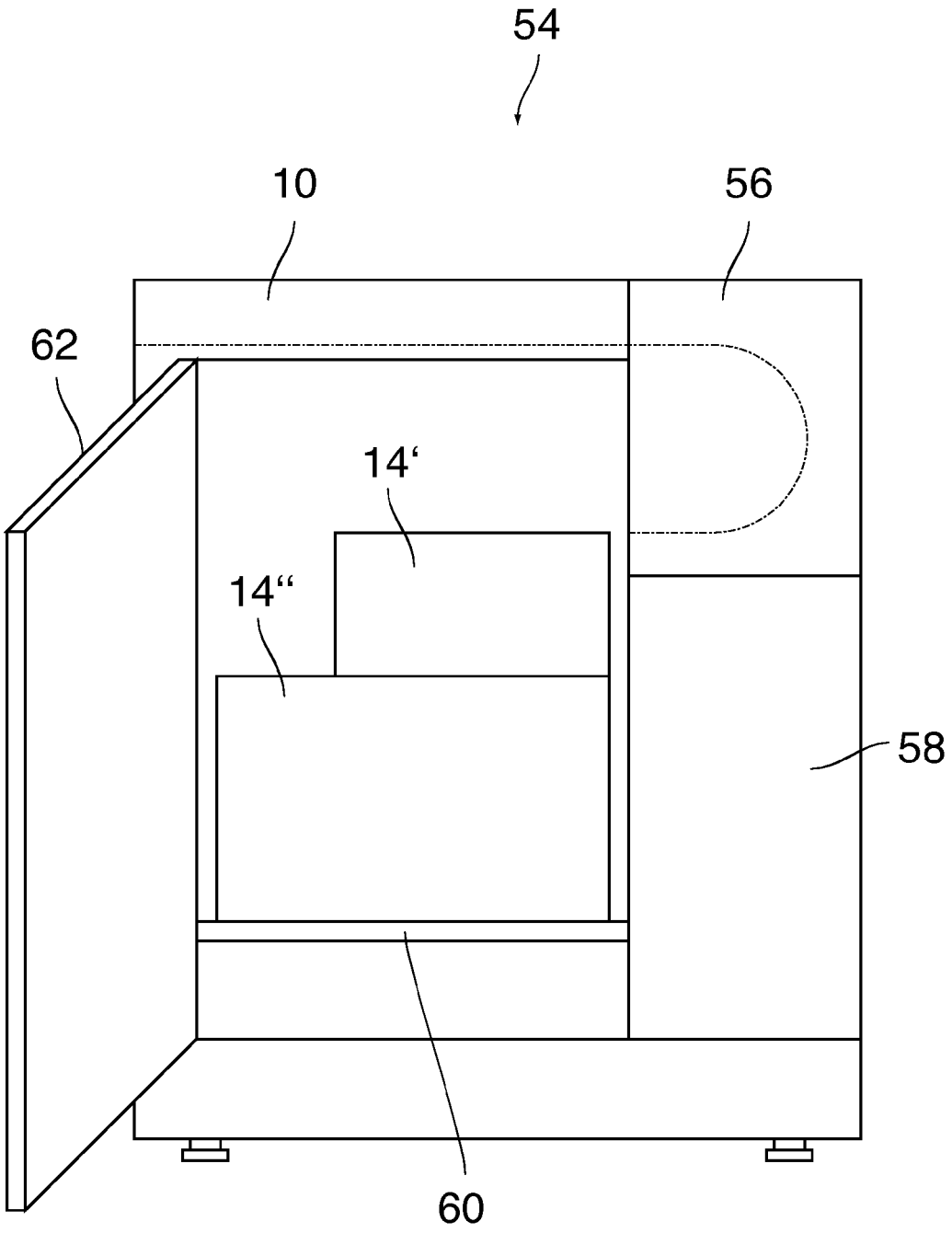
FIG. 7 is an overall view of a stacker having the sheet alignment section shown in FIGS. 1 to 6.

As an example of a sheet handling apparatus according to the invention, FIG. 7 shows a stacker 54 that is configured as a stand-alone apparatus and may be installed at the end of a print production line for example. The sheet alignment section 10 that has been described above is arranged in the top left part of the stacker in FIG. 7, and a reverse loop 56 (that may optionally be used for reversing duplex sheets) is disposed at the exit side of the alignment section 10. A lifting mechanism 58 is arranged below the reverse loop 56 and serves for controlling an upward and downward movement of a lift tray 60 on which the sheets (14" and 14' in this example) have been stacked. The height of the lift tray 60 is controlled such that the next sheet leaving the reverse loop 56 is readily placed on top of the stack. A door 62 can be opened for removing the stack of sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of European Application No. 14003407.5 filed Oct. 2, 2014, which is hereby incorporated by reference herein in its entirety.

What is claimed is:

1. A sheet transport apparatus comprising:

a first roller pair configured to transport a sheet;

a second roller pair configured to transport a sheet and that is disposed downstream of the first roller pair in a sheet transport direction, the second roller pair being provided to be able to abut and separate;

a second rollers state switching mechanism configured to switch a state of the second roller pair between an abutting state where two rollers of the second roller pair are abutted each other and a separate state where the two rollers are separate from each other;

a sheet alignment mechanism having a third roller pair that is disposed downstream of the second roller pair in the sheet transport direction, the sheet alignment mechanism configured to be performing sheet alignment by transporting the sheet using the third roller pair in a state where the second roller pair is separated;

a sheet length obtaining unit configured to obtain a sheet length in the sheet transport direction; and a controller configured to control the sheet alignment mechanism, the controller causing the sheet alignment mechanism not to perform the sheet alignment in a case where the sheet length obtained by the sheet length obtaining unit is longer than a distance from the first roller pair to the sheet alignment mechanism in the sheet transport direction.

2. The sheet transport apparatus according to claim 1, further comprising a fourth roller pair disposed between the first roller pair and the second roller pair in the sheet transport direction; and a fourth rollers state switching mechanism configured to switch a state of the second roller pair between an abutting state where two rollers of the fourth roller pair are abutted each other and a separate state where the two rollers are separate from each other, wherein when the sheet alignment is performed by the sheet alignment mechanism, the second roller pair is separated and the fourth roller pair is also separated.

3. The sheet transport apparatus according to claim 1, wherein the sheet alignment by the sheet alignment mechanism is a skew correction of the sheet.

4. The sheet transport apparatus according to claim 1, wherein the sheet alignment by the sheet alignment mechanism is a positional adjustment in a direction intersecting perpendicularly to the sheet transport direction.

5. The sheet transport apparatus according to claim 1, wherein a rotational axis of the third roller pair is inclined relative to a direction intersecting perpendicularly to the sheet transport direction.

6. The sheet transport apparatus according to claim 1, wherein the third roller pair is provided in plural numbers by being divided in an axis direction of the third roller pair and rotation speed of one roller pair of third roller pairs differs from another roller pair of third roller pairs in a case where the sheet alignment by the sheet alignment mechanism is performed.

7. The sheet transport apparatus according to claim 1, wherein the sheet alignment mechanism further comprises a registration wall provided in parallel to the sheet transport direction, wherein the registration wall being contactable with the sheet transported by the third roller pair.

8. The sheet transport apparatus according to claim 1, wherein the controller separates the third roller pair in a case where the sheet alignment by the sheet alignment mechanism is not performed.

9. The sheet transport apparatus according to claim 1, further comprising a sheet processing unit having a stacker.

10. A sheet transport apparatus comprising:

a first roller pair configured to transport a sheet;

a second roller pair configured to convey the sheet and that is disposed downstream of the first roller pair in a sheet transport direction, the second roller pair being provided to be able to abut and separate;

a sheet alignment mechanism having a third roller pair that is disposed downstream of the second roller pair in the sheet transport direction, the sheet alignment mechanism configured to be performing sheet alignment by transporting the sheet using the third roller pair in a state where the second roller pair is separated;

a fifth roller pair disposed downstream of the third roller pair;

a sheet length obtaining unit configured to obtain a sheet length in the sheet transport direction; and a controller configured to control the sheet alignment mechanism, the controller causing the sheet alignment mechanism not to perform the sheet alignment in a case where the sheet length obtained by the sheet length obtaining unit exceeds a predetermined threshold value, the predetermined threshold value being determined from a value obtained by subtracting a product of a maximum correction time required for the sheet alignment and a sheet transport speed, from a distance from the first roller pair to the fifth roller pair in the sheet transport direction.

* * * * *